United States Patent [19]

Sieurin

[11] 4,208,043

[45] Jun. 17, 1980

[54] HOLDING VESSEL

[75] Inventor: Sven I. Sieurin, Upplands Väsby, Sweden

[73] Assignee: Granges Weda AB, Upplands Väsby, Sweden

[21] Appl. No.: 922,661

[22] Filed: Jul. 7, 1978

[30] Foreign Application Priority Data

Jul. 8, 1977 [SE] Sweden ..... 7707997
Jul. 8, 1977 [SE] Sweden ..... 6607998

[51] Int. Cl.[2] ..... F27D 1/00

[52] U.S. Cl. ..... 266/275; 220/81 R; 432/262; 432/264; 432/161; 266/281; 266/286; 266/903

[58] Field of Search ..... 266/275, 280, 281, 282, 266/283, 286, 287, 903; 432/161, 197, 247, 262, 264; 220/81 R

[56] References Cited

U.S. PATENT DOCUMENTS

| | | | |
|---|---|---|---|
| 1,857,103 | 5/1932 | South | 266/280 |
| 1,883,590 | 10/1932 | Crosby et al. | 266/280 |
| 2,571,033 | 10/1951 | Harter, Jr. et al. | 222/166 |
| 2,659,120 | 11/1953 | Harter, Jr. et al. | 222/605 |
| 3,211,443 | 10/1965 | Starner et al. | 266/236 |
| 3,225,398 | 12/1965 | Davey et al. | 266/275 |
| 3,345,059 | 10/1967 | Swindt | 266/275 |
| 4,011,394 | 3/1977 | Shelley | 432/247 |

FOREIGN PATENT DOCUMENTS

| | | |
|---|---|---|
| 830244 | 2/1952 | Fed. Rep. of Germany . |
| 1191933 | 4/1965 | Fed. Rep. of Germany . |
| 2163533 | 7/1972 | Fed. Rep. of Germany . |
| 1807001 | 12/1976 | Fed. Rep. of Germany . |
| 2612912 | 9/1977 | Fed. Rep. of Germany . |
| 106746 | 3/1943 | Sweden . |
| 106747 | 3/1943 | Sweden . |
| 210134 | 1/1967 | Sweden . |
| 320768 | 2/1967 | Sweden . |
| 324863 | 6/1970 | Sweden . |
| 350333 | 10/1972 | Sweden . |
| 1167463 | 10/1969 | United Kingdom . |

*Primary Examiner*—L. Dewayne Rutledge
*Assistant Examiner*—John P. Sheehan
*Attorney, Agent, or Firm*—Fleit & Jacobson

[57] ABSTRACT

There is provided a vessel for molten metal, wherein the vessel walls containing said molten metal are constructed of rigid ceramic plates. The vessel walls along those edges along which they are connected together are provided with L- or Z-joints. Mutually co-acting joint surfaces are pressed against each other via an intermediate layer of felted ceramic sealing material by means of screws engaging said ceramic plates.

13 Claims, 4 Drawing Figures

HOLDING VESSEL

The present invention relates to vessels for holding molten metal, for example, smelting or holding vessels or chutes for the transportation of liquid metal.

Various designs of such vessels are to be found in the art. Among such vessels can be mentioned crucibles and chutes formed in one piece from graphite or ceramic material, and metalic shells lined with tamped or rammed material or heat-resistant blocks or bricks of e.g. ceramic material. In the conventional manufacture of such vessels, complicated ancillary and auxilary means are required, such as mould constructions when tamping and casting or advanced workshop equipment when manufacturing metallic shells. In order that the vessels can be manufactured at reasonable costs, it is consequently necessary to produce a relatively narrow range of such vessels in relatively large numbers. A further disadvantage with such conventional vessels is the risk of cracking when drying, firing or heating to the intended operational temperatures, such cracking resulting in rejections during manufacture or in the risk of damage and accident at the working site, particularly in conjunction with the starting-up of operations.

The object of the present invention is to provide a novel and useful vessel construction in which the aforementioned disadvantages are at least substantially eliminated.

To this end there is proposed, in accordance with the invention, a vessel for holding molten metal which is mainly characterised in that the walls containing the molten metal within the vessel are constructed of rigid ceramic plates, the vessel walls along those edges along which they are connected with each other exhibiting joints having at least two joint surfaces, arranged at an angle relative each other, such as L- or Z-joints, and in that co-operating joint surfaces are pressed against each other via an intermediate layer of ceramic sealing material. The reliability of the vessels constructed in accordance with the invention has been found in practice to be extremely high and only simple equipment is required for the manufacture of said vessels. The vessels can be produced economically with one and the same manufacturing apparatus, either singly or in small series, at practically any required dimensions and shape, thereby enabling deviation from optimal lay-out at the working site to be substantially fully avoided. The vessels according to the invention are primilarly intended for use when casting non-ferros metals, such as casting alloys having a zinc or aluminium base. Available on the open market are readily worked ceramic plates, which can be sawn, milled and drilled in approximately the same manner as wood, and which are able to withstand temperatures of from 700° to 800° C. The manufacture of ceramic plates capable of withstanding higher temperatures and which can be produced at competitive prices lie also within the scope of the possibilities afforded however. Conveniently the plates are formed in a manner such that they are not wetted, impregnated or attacked by those molten metals with which they are intended to be used. The risk of a vessel constructed in accordance with the invention cracking when handled in a normal manner is practically non-existent, since the plates which will come into contact with the molten metal shall not be fired subsequent to being assembled and since the labyrinth-like joints, which are also leakage proof, permit small, heat-occasioned movements.

From the aspect of leakage a particularly reliable and readily manufactured vessel is obtained when the walls of the vessel comprise double plates placed against each other, the peripheral edge portion of one plate projecting beyond the edge portion of an associated further plate, to form said joint surfaces.

The ceramic sealing material used as an intermediate layer between the surfaces forming the joint may be in the form of a paste, although an intermediate layer of felted ceramic material, optionally in combination with a paste-like sealing mass, has hitherto been found the most reliable.

Conveniently, the mutually co-acting joint surfaces of the vessel can be pressed against each other by means of screw joints, the screws engaging directly into the material of the ceramic plates. It will be understood, however, that other arrangements are concievable for pressing the joint surfaces together.

With respect to heat economy and to the working environment and also to the useful working life of the vessel, it is an advantage when the vessel walls are covered by a layer of insulating material and a shell surrounding the said layer. Both the insulating layers and the shell can comprise or be constructed of sheets or plates of ceramic material, the material forming the insulating material suitably being porous whilst the shell should suitably be such as to be able to contain the molten metal in question for a certain length of time in the event of a fracture or rupture in any of the vessel walls.

The insulating layers may exhibit along those edges along which they are joined to each other angled or labyrinth-like joint surfaces in substantially the same manner as those ceramic plates which form said vessel walls and which come into contact with the molten metal, so as to avoid as much as possible gas circulating in the insulating layers. Similarly, the insulating layers can, to this end, conveniently be joined to each other via material sealing the joints between them.

According to a further aspect of the invention, there is provided a vessel comprising cover members and means for supplying heat to said molten metal, wherein the walls which contain the molten metal each exhibit at least one inner layer comprising rigid ceramic plates, at least one insulating layer of porous ceramic material placed adjacent the outer surface of said inner layer, and an outer covering layer, the vessel being divided by means of internal walls into an infeed chamber, an outfeed chamber and a holding chamber for the molten metal, said holding chamber being considerably larger than the infeed and outfeed chambers and which holding chamber communicates with the infeed and outfeed chambers at a considerable distance beneath the intended level of the free surface of the molten metal, and wherein the heat-supply means is arranged in the holding chamber. By virtue of this arrangement there is obtained a vessel or furnace which is particularly economical from a thermal aspect, with uniform temperature throughout the entire melt and with minimum turbulence at the surface of the bath, thereby ensuring the minimum amount of oxidation of the heated molten metal. If the furnaces constructed in accordance with the invention are serviced and cared for in a manner befitting the artisan, the useful life of the furnaces is practically unlimited. The amount of energy consumed by the furnaces is quite insignificant compared with the amount of energy consumed by conventional furnaces of the same size, and hence the economy of such furnaces is that much more favourable.

The means for supplying heat to the melt is conveniently arranged in a space in the holding chamber above the surface of the melt, said means suitably comprising electrical heating elements. This space is separate from the surroundings and from the infeed and outfeed chambers, such that no exchange between air or gas can take place.

The infeed and outfeed chambers are preferably provided with individual lids such that the holding chamber can be constantly maintained separated from the surrounding atmosphere, thereby to expose only a minimum part of the surface of the metal bath when removing molten metal from and charging metal to said vessel.

For the purpose of not influencing the molten metal contained in the outfeed chamber in a harmful manner when refilling the furnace, the infeed and outfeed chambers are conveniently arranged at a respective corner of the vessel and arranged to communicate with the holding chamber through openings which face in a direction such that molten metal charged to the infeed chamber obtains a substantially maximum flow path to the outfeed chamber via the holding chamber. In this way the risk of slag accompanying the molten metal from reaching the outfeed chamber is substantially eliminated.

The invention will now be described with reference to a number of exemplary embodiments thereof illustrated in the accompanying schematic drawing. Like elements or substantially like elements illustrated in the various Figures of the drawing have been identified by the same references.

Figure 1:
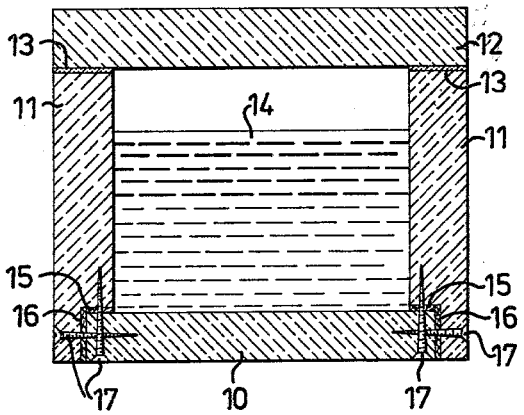
FIG. 1 is a vertical sectional view of a vessel constructed in accordance with the invention.

The vessel illustrated in FIG. 1 has a bottom 10, side walls 11 and a lid 12 which abuts the upper edges of the walls 11 through seals 13. Molten metal contained in the vessel is shown at 14. In order to ensure a good seal, the lower portion of the walls 11 are rebated or grooved in some other way so as to obtain L-shaped joints when the walls 11 and the bottom 10 are joined together. Placed in the joints are strips 15, 16 of felted ceramic material, the joint surfaces being held pressed against each other by means of screws 17. The vertical corners, where the walls 11 of the vessel meet, are suitably formed in a corresponding manner as the illustrated horizontal corners at the transition area between walls and bottom, so that angled or labyrinth-like corner joints are formed.

Figure 2:
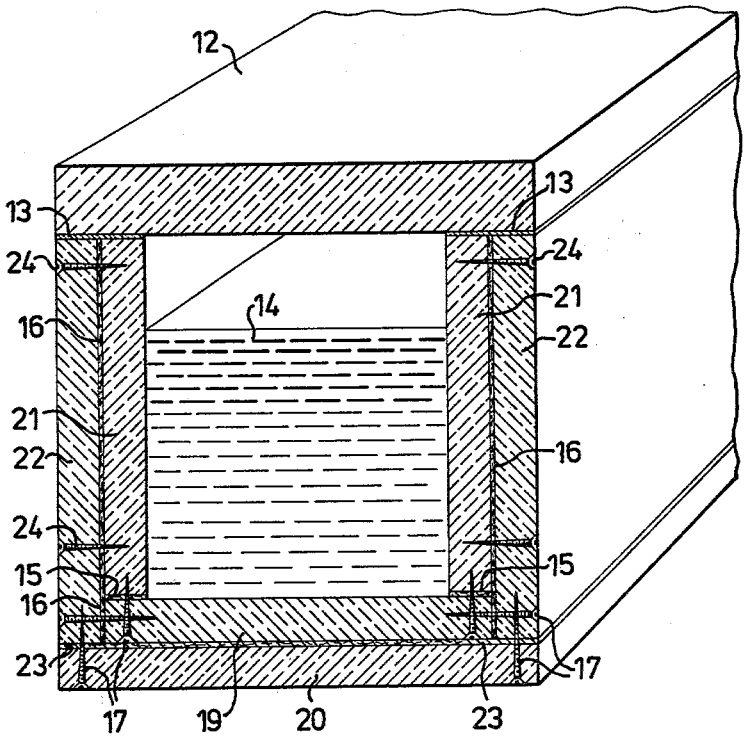
FIGS. 2 and 3 illustrate in perspective and in vertical section a portion of a second and a third embodiment of a vessel constructed in accordance with the invention.

The vessel illustrated in FIG. 2 differs from the vessel illustrated in FIG. 1 mainly by the fact that the bottom and walls are formed of double ceramic plates 19, 20 and 21, 22. The edge portions of the outer plates 20, 22 at the joints project beyond the edge portions of associated inner plates 19, 21 in a manner such as to form substantially Z-shaped joints, the joint surfaces of which are held pressed against each other by means of screws 17 via intermediate layers or inserts 15, 16, 23 of, for example, felted ceramic material. The inserts 16 and 23 extend beyond the region of the joints and suitably have the same extension as the outer plates 20, 22, in the manner illustrated. As illustrated at 24, additional screws may be arranged for clamping the outer and inner plates 19 and 20 and 21 and 22 respectively against each other via the inserts 16, 23.

Figure 3:
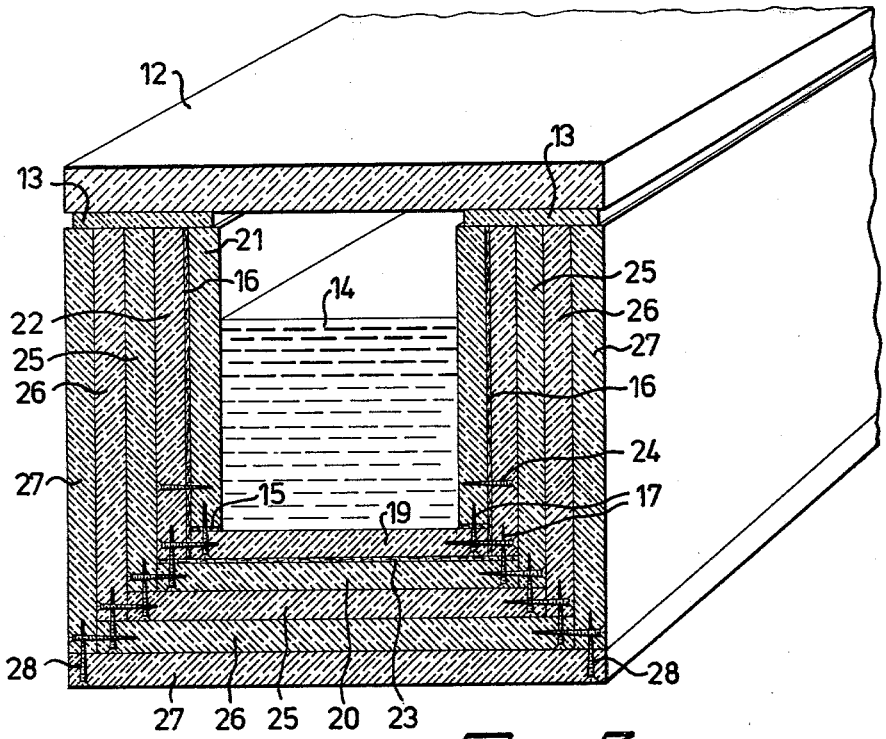

The vessel illustrated in FIG. 3 is a development of the vessel illustrated in FIG. 2. It differs from the vessel shown in FIG. 2 mainly by the fact that it is provided with an insulating structure comprising inner and outer porous plates 25, 26 of a heat-resistant, for example, ceramic material. As illustrated, the plates 25, 26 are joined together at the corners thereof in substantially the same manner as that described with reference to plates 19–22 above. The insulating structure is surrounded by a shell structure comprising ceramic plates 27 held together by screws 28.

Figure 4:
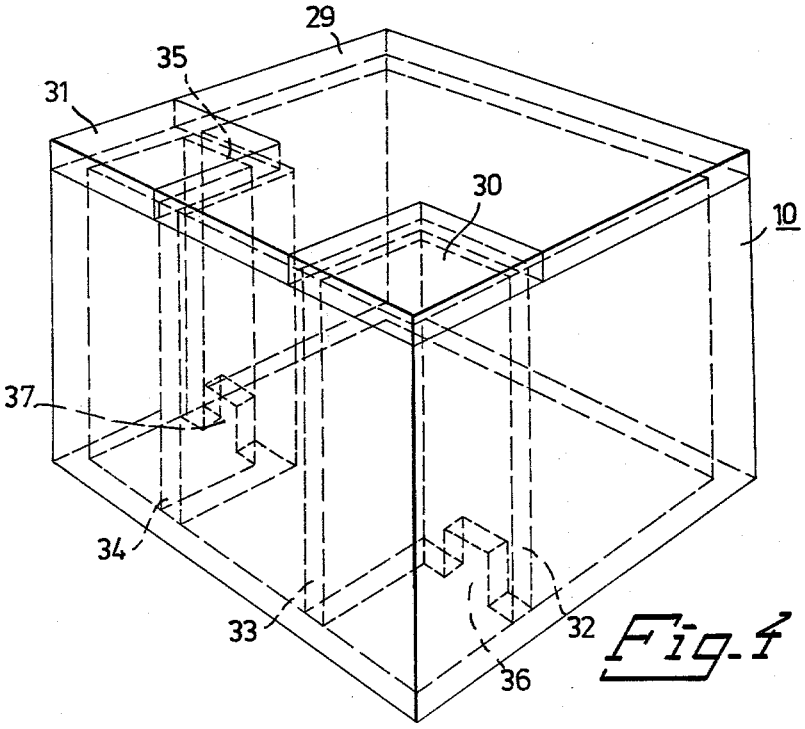
FIG. 4 illustrates schematically and in perspective a preferred design of a holding vessel.

The vessel 10 illustrated in FIG. 4 comprises a furnace provided with closing members or lids 29, 30, 31. By means of internal walls 32–35 the vessel 10 is divided into an infeed chamber covered by lid 30 and arranged to receive molten metal, an outfeed chamber covered by lid 31 and from which molten metal is removed when required, and a holding chamber covered by lid 29 and which is considerably larger than the infeed and outfeed chambers. The lid 29 covering the holding chamber carries on the underside thereof an electrical heating element (not shown) for maintaining the molten metal at the desired temperature. The infeed and outfeed chambers are located at a respective corner of the vessel 10 and are arranged such that they will only communicate with the holding chamber at a considerable distance from the intended level of the upper surface of the molten metal. To this end openings 36 and 37 are arranged in the walls 32 and 35 adjacent the bottom of the furnace. As will be seen clearly from FIG. 4, the openings face in directions such that molten metal charged to the infeed chamber obtains a substantially maximum flow path through the holding chamber to the outfeed chamber. The cover members 30 and 31 of the infeed chamber and outfeed chamber respectively are suitably provided with handels (not shown) so that they can be readily removed and replaced.

When vessels able to withstand temperatures up to approximately 800° C. are required, the plates 10, 11, 12, 19–22 and 27 conveniently comprise the ceramic sheet material sold by Johns-Manville, Colo., USA under the trade name Marinite-XL. The insulating plate 25, 26 and seals 13 may, for example, comprise the materials sold by the same company under the trade name Thermo-800 and Cerafelt CB-1000 respectively. The inserts 15, 16, 23 may conveniently comprise the felted ceramic material sold by Carborundum Co., N.Y., USA, under the designation Fiberfrax Ceramic Fiber Paper, Grade 970 J, and may conveniently have a thickness of approximately 3 mm.

The invention is not restricted to the aforedescribed and illustrated embodiments, but can be modified within the scope of the following claims.

I claim:

1. A vessel for molten metal, wherein the vessel walls containing said molten metal are constructed of rigid ceramic plates, said vessel walls being connected together at joints with said vessel walls in the region where said walls are connected to form said joints being formed into a plurality of complementary joint surfaces such that adjacent joint surfaces formed at each wall edge for connection to another wall edge are arranged substantially perpendicular to each other so as to form a stepped joint, an intermediate layer of ceramic sealing material between each pair of mutually co-acting joint surfaces, and means for pressing said mutually co-acting joint surfaces against each other, said pressing means comprising individual fasteners located only at said joints and extending into said ceramic plates through respective joint surfaces and said layer of sealing material.

2. A vessel as claimed in claim 1, wherein at least one of the vessel walls comprises double plates placed adjacent each other, the peripheral edge portion of one plate projecting beyond the edge portion of the associated second plate to form said joint surfaces.

3. A vessel according to claim 1, wherein the intermediate layer comprises felted ceramic material.

4. A vessel according to claim 1, wherein mutually co-acting joint surfaces are held pressed against each other by means of screw joints.

5. A vessel according to claim 1, wherein said vessel walls are surrounded by insulating layers and a shell surrounding said layers.

6. A vessel according to claim 5, wherein the insulating layers comprise sheets of porous ceramic material.

7. A vessel according to claim 6, wherein the insulating layers are joined together along edges which exhibit joints having at least two joint surfaces forming angles with each other, such as L- or Z-joints.

8. A vessel according to claim 7, wherein the insulating layers are joined together via material sealing the joints between them.

9. A vessel according to claim 5, wherein the shell is constructed of rigid ceramic plates.

10. A vessel according to claim 1, comprising cover members and means for supplying heat to said molten metal, wherein the walls of the vessel containing the molten metal each exhibit at least one inner layer comprising rigid ceramic plates, at least one insulating layer placed against the outer surface of said inner layer and which comprises porous ceramic material, and an outer cover layer, the vessel being divided by means of internal walls into an infeed chamber, an outfeed chamber and a holding chamber for the molten metal, said holding chamber being considerably larger than the infeed and outfeed chambers and communicating with the infeed and outfeed chambers at a considerable distance beneath the intended level of the free surface of the molten metal, and wherein the heat-supply means is arranged in said holding chamber.

11. A vessel according to claim 10, wherein the heat-supply means is arranged in a space located above the molten metal in the holding chamber.

12. A vessel according to claim 10, wherein the outfeed chamber is provided with a separate lid.

13. A vessel according to claim 10, wherein the infeed and outfeed chambers are each arranged at a respective corner of the vessel and communicate with the holding chamber through openings which face in a direction such that molten metal passed to the infeed chamber obtains a substantially maximum flow path to the outfeed chamber through the holding chamber.

* * * * *